US007299656B2

(12) United States Patent
Weber et al.

(10) Patent No.: US 7,299,656 B2
(45) Date of Patent: Nov. 27, 2007

(54) CRYOGENIC RECTIFICATION SYSTEM FOR NEON PRODUCTION

(75) Inventors: Joseph Alfred Weber, Cheektowaga, NY (US); Neil Mark Prosser, Lockport, NY (US)

(73) Assignee: Praxair Technology, Inc., Danbury, CT (US)

( * ) Notice: Subject to any disclaimer, the term of this patent is extended or adjusted under 35 U.S.C. 154(b) by 364 days.

(21) Appl. No.: 11/060,781

(22) Filed: Feb. 18, 2005

(65) Prior Publication Data

US 2006/0185389 A1 Aug. 24, 2006

(51) Int. Cl.
*F25J 3/00* (2006.01)

(52) U.S. Cl. ..... 62/643; 62/923

(58) Field of Classification Search ..... 62/643, 62/923

See application file for complete search history.

(56) References Cited

U.S. PATENT DOCUMENTS

| | | | | | |
|---|---|---|---|---|---|
| 2,096,694 | A | * | 10/1937 | Erb | 62/643 |
| 2,497,589 | A | * | 2/1950 | Dennis | 62/648 |
| 3,073,093 | A | * | 1/1963 | Baker et al. | 95/174 |
| 4,824,453 | A | * | 4/1989 | Rottmann et al. | 62/648 |
| 5,100,446 | A | * | 3/1992 | Wisz | 62/648 |
| 5,137,559 | A | | 8/1992 | Agrawal | 62/24 |
| 5,167,125 | A | | 12/1992 | Agrawal | 62/24 |
| 6,260,380 | B1 | * | 7/2001 | Arman et al. | 62/646 |

* cited by examiner

*Primary Examiner*—William C Doerrler
(74) *Attorney, Agent, or Firm*—David M. Rosenblum

(57) ABSTRACT

A cryogenic rectification system employing a phase separator, which may include one or more trays, in conjunction with a double column air separation plant, wherein some shelf liquid is subcooled and phase separated to produce crude neon vapor, and the remaining liquid is used to reflux the lower pressure column of the double column plant.

12 Claims, 4 Drawing Sheets

CRYOGENIC RECTIFICATION SYSTEM FOR NEON PRODUCTION

TECHNICAL FIELD

This invention relates generally to cryogenic rectification of air and, more particularly, to the cryogenic rectification of air for the production of neon.

BACKGROUND ART

Neon is a valuable inert gas found in low concentrations of about 18 parts per million (ppm) in air. Neon is useful as a filling gas in lamps and luminous sign tubes. In addition, neon is used in airplane beacons because neon light can penetrate fog where other lights cannot. Systems which can improve the recovery of neon would be highly desirable.

SUMMARY OF THE INVENTION

One aspect of the invention is:

A method for producing crude neon comprising:

(A) separating feed air by cryogenic rectification in a higher pressure column to produce neon-containing shelf vapor, and condensing at least a portion of the neon-containing shelf vapor to produce neon-containing liquid;

(B) subcooling the neon-containing liquid, passing the resulting fluid into a separator, and separating the fluid within the separator into neon-containing vapor and remaining liquid; and (C) passing remaining liquid from the separator into a lower pressure column, and recovering neon-containing vapor as product crude neon.

Another aspect of the invention is:

Apparatus for producing crude neon comprising:

(A) a higher pressure column, a lower pressure column having a reboiler/condenser, and means for passing feed air into the higher pressure column;

(B) a subcooler, a separator, means for passing neon-containing fluid from the higher pressure column to the reboiler/condenser, from the reboiler/condenser to the subcooler, and from the subcooler to the separator; and (C) means for passing liquid from the separator to the lower pressure column, and means for recovering vapor from the separator as product crude neon.

As used herein the term "feed air" means a mixture comprising primarily oxygen and nitrogen, and also containing neon, such as ambient air.

As used herein the term "column" means a distillation or fractionation column or zone, i.e. a contacting column or zone, wherein liquid and vapor phases are countercurrently contacted to effect separation of a fluid mixture, as for example, by contacting of the vapor and liquid phases on a series of vertically spaced trays or plates mounted within the column and/or on packing elements such as structured or random packing. For a further discussion of distillation columns, see the Chemical Engineer's Handbook, fifth edition, edited by R. H. Perry and C. H. Chilton, McGraw-Hill Book Company, New York, Section 13, The Continuous Distillation Process.

Vapor and liquid contacting separation processes depend on the difference in vapor pressures for the components. The high vapor pressure (or more volatile or low boiling) component will tend to concentrate in the vapor phase whereas the low vapor pressure (or less volatile or high boiling) component will tend to concentrate in the liquid phase. Partial condensation is the separation process whereby cooling of a vapor mixture can be used to concentrate the volatile component(s) in the vapor phase and thereby the less volatile component(s) in the liquid phase. Rectification, or continuous distillation, is the separation process that combines successive partial vaporizations and condensations as obtained by a countercurrent treatment of the vapor and liquid phases. The countercurrent contacting of the vapor and liquid phases is generally adiabatic and can include integral (stagewise) or differential (continuous) contact between the phases. Separation process arrangements that utilize the principles of rectification to separate mixtures are often interchangeably termed rectification columns, distillation columns, or fractionation columns. Cryogenic rectification is a rectification process carried out at least in part at temperatures at or below 150 degrees Kelvin (K).

As used herein the term "indirect heat exchange" means the bringing of two fluids into heat exchange relation without any physical contact or intermixing of the fluids with each other.

As used herein the terms "reboiler" and "reboiler/condenser" mean a heat exchange device that generates column or separator vapor from liquid.

As used herein the terms "subcooling" and "subcooler" mean respectively method and apparatus for cooling a liquid to be at a temperature lower than the saturation temperature of that liquid for the existing pressure.

As used herein the terms "upper portion" and "lower portion" mean those sections of a column respectively above and below the mid point of the column.

As used herein the term "crude neon" means a fluid having a neon concentration within the range of from 400 ppm to 10,000 ppm.

As used herein the term "tray" means a vapor-liquid contacting stage.

As used herein the term "phase separator" means a vessel wherein incoming feed is separated into individual vapor and liquid fractions. Typically the vessel has sufficient cross-sectional area so that the vapor and liquid are separated by gravity.

DETAILED DESCRIPTION

Figure 1:
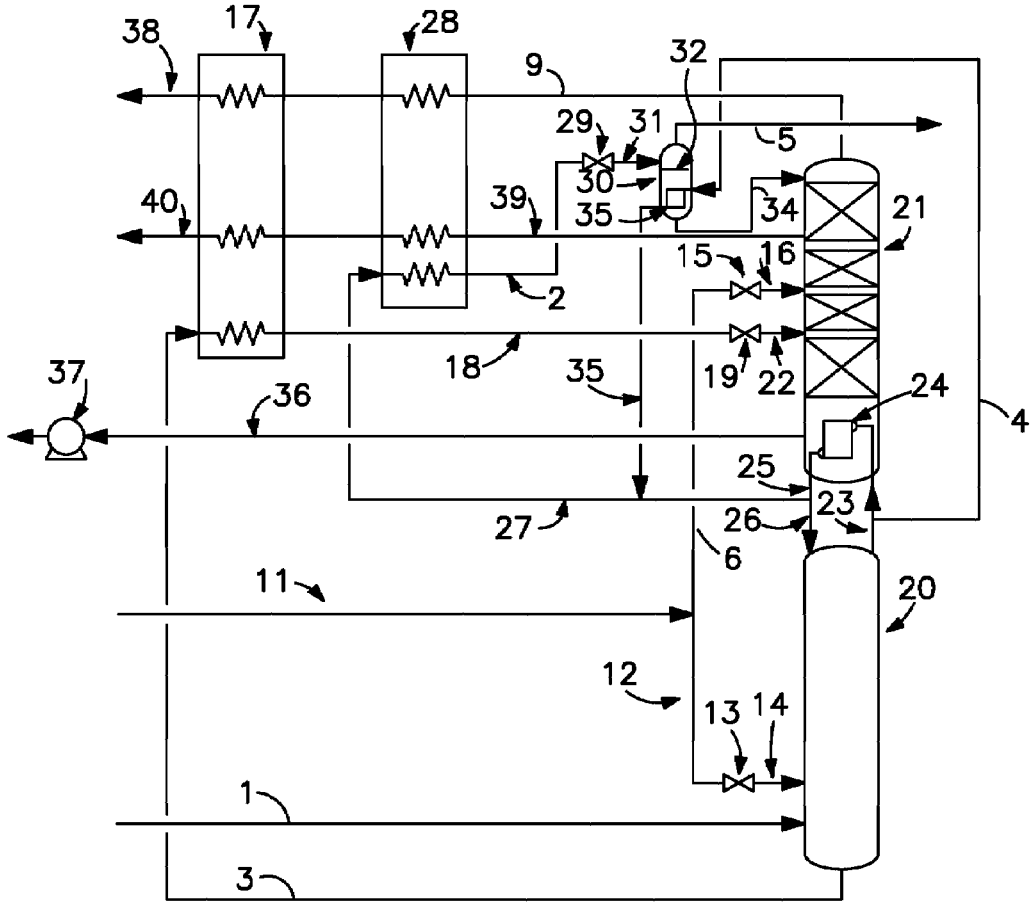
FIG. 1 is a simplified schematic representation of one preferred embodiment of the cryogenic rectification system of this invention wherein the separator includes at least one tray.

The invention will be described in detail with reference to the Drawings. Referring now to FIG. 1, feed air 1 is passed into higher pressure column 20 which is operating at a pressure generally within the range of from 60 to 220 pounds per square inch absolute (psia). In the embodiment of the invention illustrated in FIG. 1, feed air 1 is a gaseous stream, and liquid feed air in stream 11 is also provided into the system. Stream 11 is divided into stream 12 which is passed through valve 13 and into higher pressure column 20 as stream 14, and into stream 6 which is passed through valve 15 and into lower pressure column 21 as stream 16.

Within higher pressure column 20 the feed air is separated by cryogenic rectification into oxygen-enriched liquid and nitrogen-enriched vapor. Oxygen-enriched liquid is withdrawn from the lower portion of column 20 in stream 3, cooled by passage through heat exchanger 17 to form stream 18, and passed through valve 19 and into lower pressure column 21 as stream 22. Nitrogen-enriched vapor or shelf vapor, containing from 30 to 70 ppm neon, is withdrawn from the upper portion of higher pressure column 20 in stream 23 and passed into reboiler/condenser 24 wherein it is condensed by indirect heat exchange with lower pressure column bottom liquid. This neon-containing liquid is withdrawn from reboiler/condenser 24 in stream 25. A portion 26 of stream 25 is passed back into the upper portion of higher pressure column 20 as reflux. Another portion of the neon-containing fluid from reboiler/condenser 24 is passed in stream 27 to subcooler 28.

Within subcooler 28 the neon-containing liquid is subcooled by indirect heat exchange with nitrogen streams from the lower pressure column, and the resulting fluid is withdrawn from subcooler 28 as subcooled neon-containing liquid in stream 2. Stream 2 is passed through valve 29 and then into separator 30 in stream 31.

In the embodiment of the invention illustrated in FIG. 1, separator 30 contains at least one tray 32. That is, in the embodiment of the invention illustrated in FIG. 1 separator 30 is a small rectification column. Separator 30 also contains reboiler 33 which is driven by a portion of the shelf vapor passed to reboiler 33 in stream 4. Within separator 30 the neon-containing liquid is separated into neon-containing vapor and remaining liquid. The remaining liquid is passed from separator 30 in stream 34 into the upper portion of lower pressure column 21. This liquid yields high purity nitrogen product containing very low concentrations of light components owing to the removal of much of the light components with the crude neon. The neon-containing vapor is recovered from separator 30 in stream 5 as product crude neon. Typically the crude neon is provided to a neon refinery for the production of high purity or refined neon. The neon-containing shelf vapor in stream 4, which is condensed in reboiler 33, is passed out of reboiler 33 in stream 35. Preferably, as illustrated in FIG. 1, stream 35 is passed into stream 27 and then passed to subcooler 28 and ultimately into separator 30 for subsequent recovery of the neon in this fluid as part of the crude neon in stream 5.

Lower pressure column 21 is operating at a pressure less than that of higher pressure column 20 and generally within the range of from 16 to 75 psia. Within lower pressure column 21 the various fluids passed into that column are separated by cryogenic rectification into oxygen-rich liquid and nitrogen-rich vapor. Oxygen-rich liquid is withdrawn from the lower portion of column 21 in stream 36 for recovery as product oxygen having an oxygen concentration of at least 90 mole percent. If desired, as shown in FIG. 1, the oxygen-rich liquid may be increased in pressure by pump 37 prior to recovery as high pressure liquid and/or gaseous oxygen. Nitrogen-rich vapor is withdrawn from the upper portion of column 21 in stream 9, warmed by passage through subcooler 28 and heat exchanger 17, and recovered as product nitrogen 38 having a nitrogen concentration of at least 99.9 mole percent. For product purity control purposes a nitrogen-containing waste stream 39 is withdrawn from column 21 below the withdrawal level of stream 9, warmed by passage through subcooler 28 and heat exchanger 17, and removed from the system in stream 40.

Figure 2:
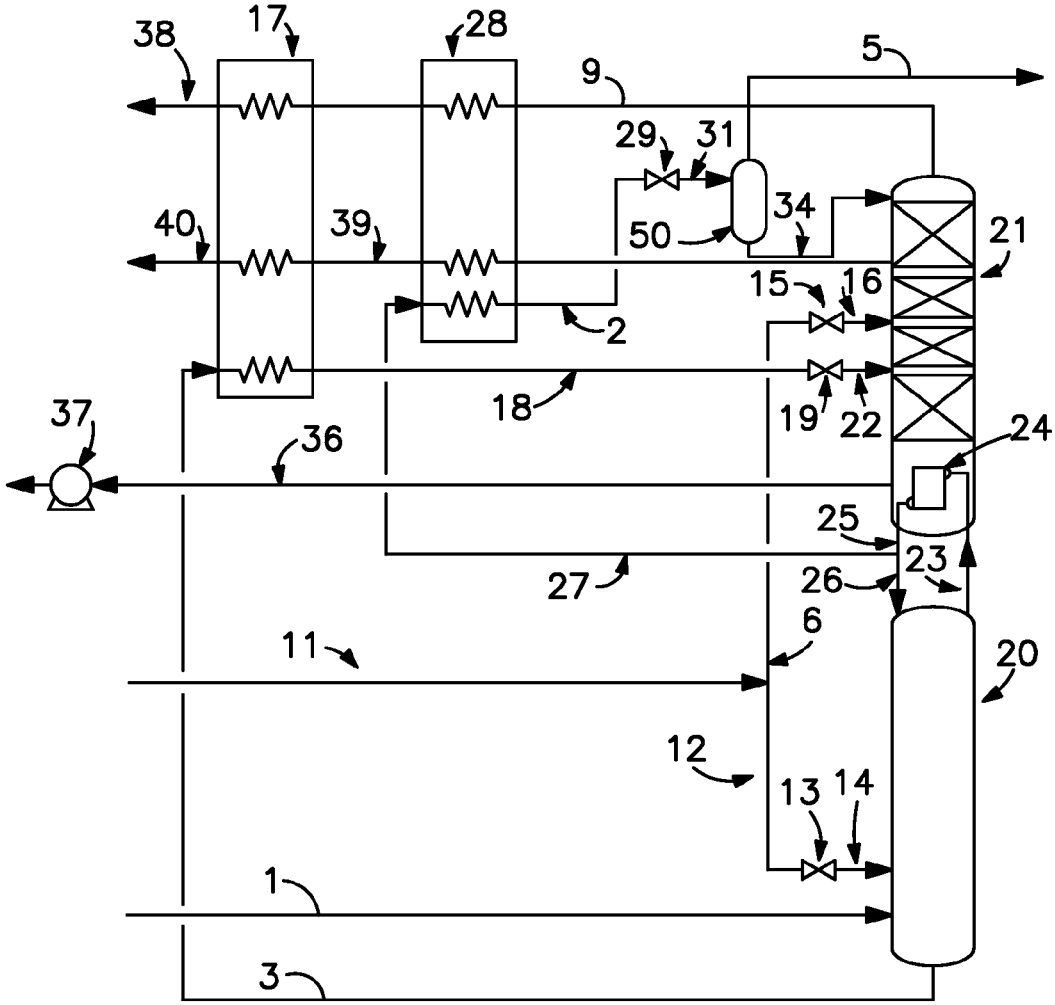
FIG. 2 is a schematic representation of yet another preferred embodiment of the cryogenic rectification system of this invention wherein the separator is a phase separator

FIG. 2 illustrates another embodiment of the invention wherein the separator is a phase separator. The numerals in FIG. 2 are the same as the numerals in FIG. 1 for the common elements and these common elements will not be described again in detail. In the embodiment of the invention illustrated in FIG. 2, the phase separator 50 does not contain a reboiler so that the phase separation is essentially totally as a result of flashing through valve 29 and gravitational separation within the phase separator. However, phase separator 50 could contain a reboiler in which case the fluid flow employing streams 4 and 35 illustrated in FIG. 1 would also be employed with the embodiment of the invention illustrated in FIG. 2.

Figure 3:
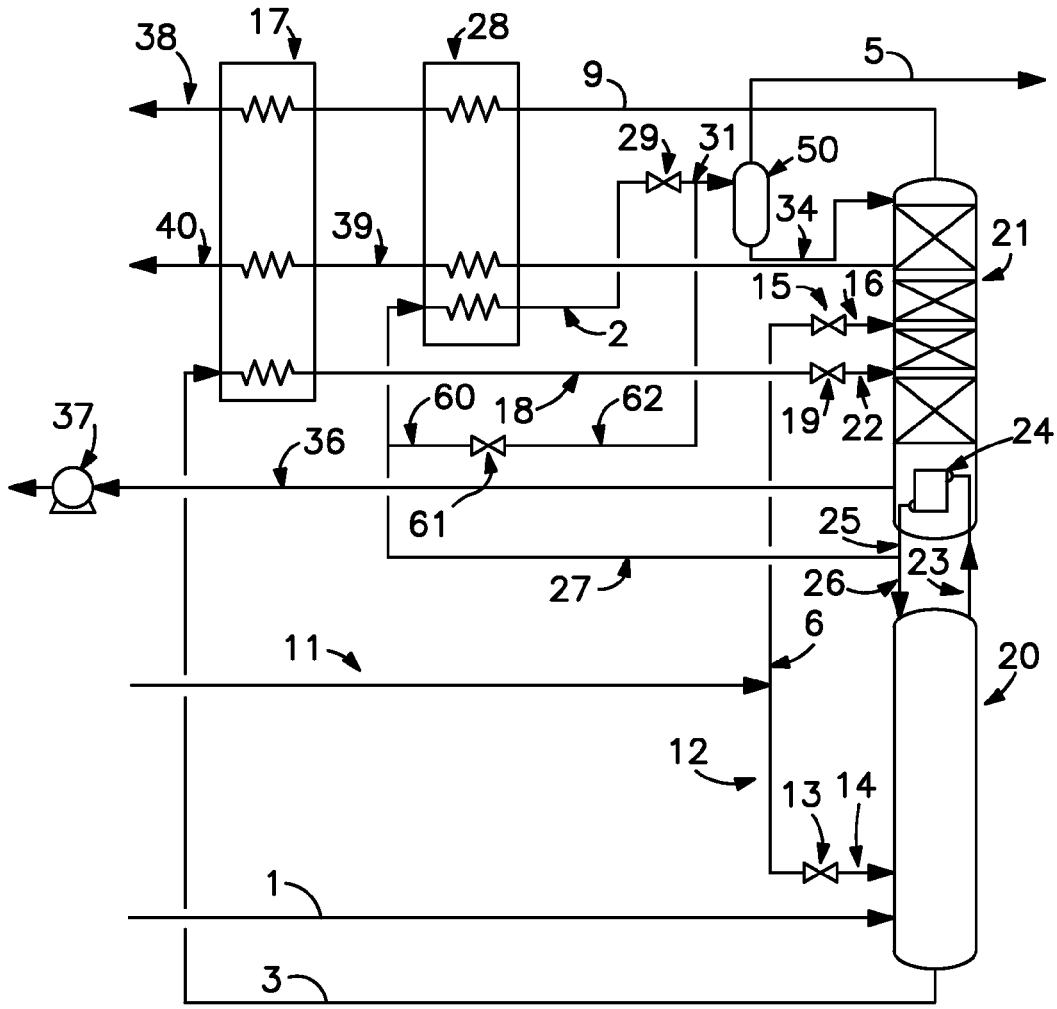
FIG. 3 is a schematic representation of yet another preferred embodiment of the cryogenic rectification system of this invention wherein some of the neon-containing liquid bypasses the subcooler.

The numerals in the embodiment of the invention illustrated in FIG. 3 are the same as those of FIG. 2 for the common elements, and these common elements will not be described again in detail. Referring now to FIG. 3, a portion 60 of stream 27 is not subcooled but rather is passed through valve 61 and as stream 62 is combined with flashed stream 31. This increases the amount of vapor produced in phase separator 50 thus increasing the recovery of the more volatile neon which preferentially concentrates in the vapor rather than in the remaining liquid which is passed from the separator into the lower pressure column.

Figure 4:
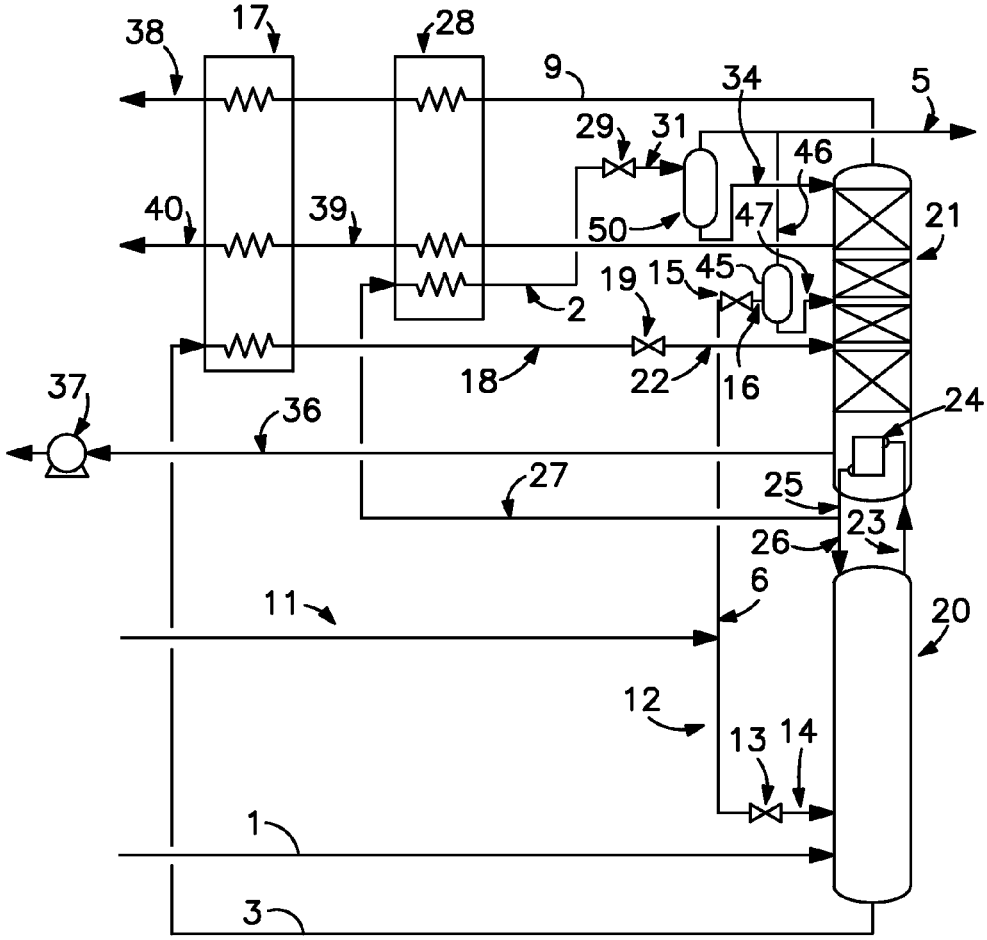
FIG. 4 is a schematic representation of another preferred embodiment of the invention wherein liquid feed air is flashed, the vapor is recovered as part of the crude neon, and the remaining liquid is passed into the lower pressure column.

The numerals in the embodiment of the invention illustrated in FIG. 4 are the same as those of FIG. 2 for the common elements, and these common elements will not be described again in detail. Referring now to FIG. 4, liquid air stream 6 which is flashed through valve 15 is passed in stream 16 to feed air phase separator 45. Vapor from feed air phase separator 45 is passed in stream 46 to crude neon stream 5 to form part of the crude neon product. Liquid from feed air phase separator 45 is passed in stream 47 into lower pressure volume 21. This embodiment of the invention serves not only to increase the recovery of neon but also enhances the purity of the nitrogen product because light impurities, which would otherwise be in the nitrogen product, are removed from the system in stream 46.

A computer simulation of the embodiment of the invention illustrated in FIG. 1 was carried out and the results are presented in Table 1. These results are presented for illustrative purposes and are not intended to be limiting. The stream numbers correspond to those of FIG. 1.

TABLE 1

| | Main Air Stream (1) | Total Liq. Air Stream (11) | Liquid Air to Lower Pressure Column (6) | Oxygen-Enriched Liquid (3) | Subcooled Liquid (2) |
|---|---|---|---|---|---|
| F, MCFH | 715 | 305 | 183 | 530.6 | 306.4 |
| P, psia | 87.45 | 754.6 | 754.6 | 87.45 | 84.0 |

TABLE 1-continued

| | | | | | |
|---|---|---|---|---|---|
| T, K | 100.7 | 94.27 | 94.28 | 100.0 | 82.14 |
| XN2 | 0.78110 | 0.78110 | 0.78110 | 0.65479 | 0.99980 |
| XAr | 0.009343 | 0.009343 | 0.009343 | 0.014666 | 0.000125 |
| XO2 | 0.209530 | 0.209530 | 0.209530 | 0.330544 | 1.5 ppm |
| XH2, ppm | 3.0 | 3.0 | 3.0 | 0.0415 | 8.12 |
| XNe. ppm | 18.2 | 18.2 | 18.2 | 0.298 | 49.19 |
| XHe ppm | 5.2 | 5.2 | 5.2 | 0.022 | 14.16 |
| XCO, ppm | 1.0 | 1.0 | 1.0 | 1.13 | 0.778 |

| | Neon Crude (5) | Liquid (34) | Nitrogen Product (9) | Reboiler Flow (4) |
|---|---|---|---|---|
| F, MCFH | 11.01 | 295.4 | 587.4 | 5.0 |
| P, psia | 20.22 | 20.22 | 20.02 | 84.0 |
| T, K | 80.23 | 80.23 | 80.16 | 95.96 |
| XN2 | 0.997997 | 0.99987 | 0.999822 | 0.99980 |
| XAr | 5.247E-05 | 1.282E-04 | 1.629E-04 | 0.000125 |
| XO2, ppm | 0.44 | 1.539 | 1.0 | 1.5 |
| XH2, ppm | 221.3 | 0.177 | 0.813 | 8.12 |
| XNe. ppm | 1333.5 | 1.33 | 5.09 | 49.19 |
| XHe ppm | 394.2 | 0.003 | 1.22 | 14.16 |
| XCO ppm | 0.533 | 0.788 | 0.986 | 0.778 |

Although the invention has been described in detail with reference to certain preferred embodiments, those skilled in the art will recognize that there are other embodiments of the invention within the spirit and the scope of the claims.

The invention claimed is:

1. A method for producing crude neon comprising:

(A) separating feed air by cryogenic rectification in a higher pressure column to produce neon-containing shelf vapor, and condensing at least a portion of the neon-containing shelf vapor to produce neon-containing liquid;

(B) subcooling the neon-containing liquid, passing the resulting fluid into a separator, and separating the fluid within the separator into neon-containing vapor and remaining liquid; and (C) passing remaining liquid from the separator into a lower pressure column, and recovering neon-containing vapor as product crude neon.

2. The method of claim 1 wherein the separator contains at least one tray.

3. The method of claim 1 wherein the separator contains a reboiler and wherein neon-containing shelf vapor is passed to the reboiler.

4. The method of claim 1 wherein a portion of the neon-containing liquid is passed to the separator without being subcooled.

5. The method of claim 1 further comprising passing liquid feed air into the lower pressure column.

6. The method of claim 1 further comprising partially vaporizing a liquid feed air stream, passing the remaining liquid into the lower pressure column, and recovering the resulting vapor as part of the product crude neon.

7. Apparatus for producing crude neon comprising:

(A) a higher pressure column, a lower pressure column having a reboiler/condenser, and means for passing feed air into the higher pressure column;

(B) a subcooler, a separator, means for passing neon-containing fluid from the higher pressure column to the reboiler/condenser, from the reboiler/condenser to the subcooler, and from the subcooler to the separator; and (C) means for passing liquid from the separator to the lower pressure column, and means for recovering vapor from the separator as product crude neon.

8. The apparatus of claim 7 wherein the separator contains at least one tray.

9. The apparatus of claim 7 wherein the separator contains a reboiler and further comprising means for passing fluid from the higher pressure column to the reboiler.

10. The apparatus of claim 9 further comprising means for passing fluid from the reboiler to the subcooler.

11. The apparatus of claim 7 further comprising means for passing fluid from the reboiler/condenser to the separator without passing through the subcooler.

12. The apparatus of claim 7 further comprising a feed air phase separator, means for passing partially vaporized feed air to the feed air phase separator, means for passing liquid from the feed air phase separator to the lower pressure column, and means for passing vapor from the feed air phase separator to the product crude neon.

* * * * *